US006644389B1

(12) United States Patent
Kang et al.

(10) Patent No.: US 6,644,389 B1
(45) Date of Patent: Nov. 11, 2003

(54) FIN TUBE HEAT EXCHANGER

(75) Inventors: Hie-chan Kang, Kunsan (KR); Moo-hwan Kim, Pohang (KR)

(73) Assignee: Pohang University of Science and Technology Foundation, Kyungsangbuk-do (KR)

( * ) Notice: Subject to any disclaimer, the term of this patent is extended or adjusted under 35 U.S.C. 154(b) by 0 days.

(21) Appl. No.: 09/936,048

(22) PCT Filed: Apr. 9, 1999

(86) PCT No.: PCT/KR99/00172

§ 371 (c)(1),
(2), (4) Date: Dec. 17, 2001

(87) PCT Pub. No.: WO00/53990

PCT Pub. Date: Sep. 14, 2000

(30) Foreign Application Priority Data

Mar. 9, 1999 (KR) ..... 1999-7772

(51) Int. Cl.[7] ..... F28F 13/02; F28D 1/04
(52) U.S. Cl. ..... 165/146; 165/151; 165/181
(58) Field of Search ..... 165/151, 181, 165/146

(56) References Cited

U.S. PATENT DOCUMENTS

| | | | | | |
|---|---|---|---|---|---|
| 2,038,912 | A | * | 4/1936 | Summers | 165/151 |
| 3,182,481 | A | * | 5/1965 | Oddy et al. | 165/151 |
| 3,750,418 | A | * | 8/1973 | Maudlin | 165/181 |
| 4,041,727 | A | * | 8/1977 | Maudlin | 165/181 |
| 4,169,502 | A | * | 10/1979 | Kluck | 165/151 |
| 4,691,767 | A | * | 9/1987 | Tanaka et al. | 165/151 |
| 4,715,437 | A | * | 12/1987 | Tanaka et al. | 165/151 |
| 4,723,600 | A | * | 2/1988 | Yokoyama et al. | 165/151 |
| 4,738,225 | A | * | 4/1988 | Juang | 165/151 |
| 4,832,117 | A | * | 5/1989 | Kato et al. | 165/151 |
| 4,909,319 | A | * | 3/1990 | Ishikawa et al. | 165/151 |
| 5,117,902 | A | * | 6/1992 | Kusuhara et al. | 165/151 |
| 5,482,115 | A | * | 1/1996 | Ikeya et al. | 165/151 |
| 5,660,230 | A | * | 8/1997 | Obosu et al. | 165/151 |

FOREIGN PATENT DOCUMENTS

| | | | | |
|---|---|---|---|---|
| JP | 61114091 | A | * 5/1986 | 165/151 |
| JP | 63259393 | A | * 10/1988 | 165/151 |

* cited by examiner

*Primary Examiner*—Leonard Leo
(74) *Attorney, Agent, or Firm*—Leydig, Voit & Mayer, LTD

(57) ABSTRACT

A fin tube heat exchanger includes plate-shaped elongated fin members spaced at regular intervals, in parallel with one another. Each fin member has a fin base, through-holes in two rows in a longitudinal direction of the fin member, and raised portions with legs. Heat exchanger tubes are inserted into the through-holes. Each fin member has flat areas at a front and middle regions of a front half and a middle region of a rear half. The raised portion disposed at a rear region of the front half and a front region of the rear half has the legs inclined by a predetermined angle with respect to a traverse centerline which passes through the center of an adjacent through-hole of the front row. The distance from the centerline generally increases with a direction of airflow. A larger volume of air can be directed toward the vicinity of the tubes of the rear row. Each fin member has a front edge and a rear edge. The front edge has protruding portions and recessed portions and the rear edge has protruding portions and recessed portions. The protruding portion of the front edge substantially corresponds to the recessed portion of the rear edge disposed on the same centerline.

14 Claims, 3 Drawing Sheets

FIN TUBE HEAT EXCHANGER

FIELD OF THE INVENTION

The present invention relates to a heat exchanger having a plurality of fin members for exchanging heat between two fluids, for example, between refrigeration medium and air or the like.

BACKGROUND OF THE INVENTION

There have been various attempts to enhance the performance of a fin tube heat exchanger used in an air-conditioner or refrigerator. In particular, developments on the structure of thin, plate-shaped fin member of the fin tube heat exchanger have been carried out in order to obtain the higher heat exchange performance.

In order to enhance the performance of the heat exchanger, a plurality of cut and raised portions are formed on each fin member. For example, U.S. Pat. No. 4,832,117 to Kato discloses a thin, plate-shaped fin member having a plurality of raised portions. Each fin member has a fin base on which aligned through-holes are formed, and a plurality of the raised portions. Legs of the raised portions are inclined with respect to a longitudinal front edge so that each leg generally conforms to the tangent line of the nearest through-hole. Further, the raised portions are formed over the entire width of the fin member.

In this configuration, the airflow may be led to pass through the area spaced from a heat exchanger tube inserted in each through-hole. Thus, the heat exchange performance between air and the fin member may be insufficient. In addition, the raised portions formed over the entire width of the fin member may resist against the airflow, and thus, the pressure drop increases. This may cause the undesirable noise. Further, the excessive number of the raised portions may cause the cost of making a stamping die for the fin member to be higher, and the life of the stamping die to be shorter.

As above, it is necessary that the fin tube heat exchanger has fin members on which the raised portions are formed in a manner such that the resistance against the airflow is minimized while the good performance of the heat exchange is maintained.

In addition, there is a need that each fin member is configured so that the raw material for making it is saved while the good performance of the heat exchange is maintained.

SUMMARY OF THE INVENTION

Accordingly, it is an object of the present invention to provide a fin tube heat exchanger having a plurality of fin members that are configured so that the resistance against the airflow is minimized while good performance of the heat exchange is maintained.

It is another object of the present invention to provide a fin tube heat exchanger having a plurality of fin members that are configured so that the raw material, for example aluminum strip or plate, for making them is saved while the good performance of the heat exchange is maintained.

The above and other objects of the present invention are accomplished by providing a fin tube heat exchanger comprising:

a plurality of plate-shaped elongated fin members spaced at regular intervals in parallel with one another, each fin member having a fin base, a plurality of through-holes in at least two rows in a longitudinal direction of the fin member and a plurality of raised portions with legs;

a plurality of heat exchanger tubes inserted into said through-holes;

each fin member having flat areas at a front and middle regions of a front half and a middle region of a rear half, and each raised portion disposed at least at a rear region of the front half and a front region of the rear half, and having the legs inclined by a predetermined angle with respect to a traverse centerline which passes through the center of a adjacent through-hole of the front row in a manner such that the more volume of the air is directed toward the vicinity of the tubes of the rear row.

In accordance with another aspect of the invention, it is provided a fin tube heat exchanger having a plurality of plate-shaped fin member spaced at regular intervals in parallel and a plurality of tubes, each fin member has a front edge and a rear edge, the front edge having protruded portions and recessed portions and the rear edge having protruded portions and recessed portions.

BRIEF DESCRIPTION OF THE DRAWINGS

The above and other objects, advantages and features of the present invention will be apparent from the following description of preferred embodiments taken in conjunction with the accompanying drawings, wherein.

DETAILED DESCRIPTION OF THE PREFERRED EMBODIMENT

Figure 1A:
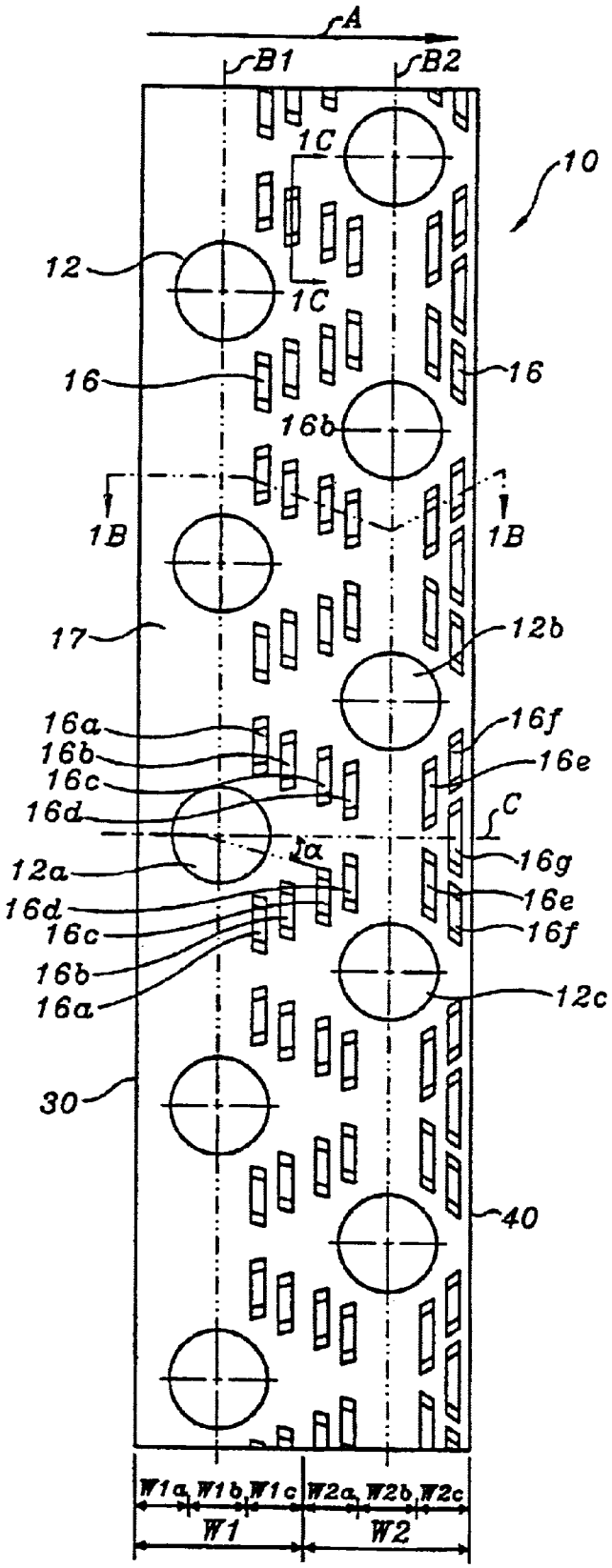
FIG. 1A is a side view showing a part of a fin member in accordance with the first embodiment of the present invention.
Figure 1B:
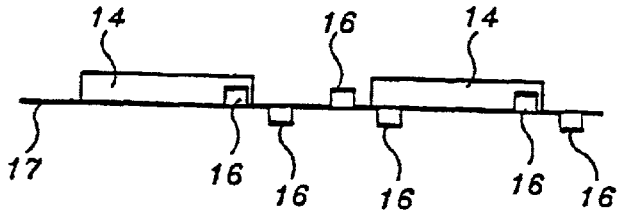
FIG. 1B is a sectional view taken along the line 1B—1B in FIG. 1A.
Figure 1C:
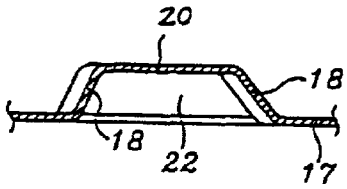
FIG. 1C is an enlarged view of a raised portion of the fin member shown in FIG. 1A taken in a direction of airflow.

Referring to FIGS. 1A to 1C, a fin tube heat exchanger in accordance with the first embodiment of the present invention has a plurality of thin, plate-shaped aluminum fin members 10. The fin members 10 are spaced at regular intervals in parallel with one another. Two rows B1 and B2 of a plurality of regularly spaced through-holes 12 are formed in each plate-shape fin member 10 along its longitudinal direction. A heat exchanger tube is inserted in each through-hole 12. The through-holes 12 of the rear row B2 are offset from and positioned between those 12 of the front row B1 in a direction of airflow A. It is preferable that each through-hole 12 of the rear row B2 is disposed on a traverse line, which passes through the middle between the adjacent through-holes of the front row B1. An annular fin collar 14 is integrally formed with the fin member surrounding each through-hole 12 so that heat transfer between the tubes and the fin member 10 can be effectively conducted.

Each fin member 10 has a plurality of cut and raised portions 16 protruding from a fin base 17. Each raised portion 16 has two legs 18 disposed along the longitudinal direction of the fin member 10 and a bridge 20 connecting the two legs 18. The bridge 20 extends along the longitudinal direction of the fin member 10. An opening 22 is formed by the legs 18 and bridge 20 and thus the air flows through the opening 22 (see FIG. 1C). The legs 18 are inclined with respect to the traverse centerline C of the through-hole 16, as discussed in detail below.

For convenience of explanation, the fin member 10 is divided into regions as described below. First, the fin member 10 is divided into a front half W1 and a rear half W2. The front half W1 is divided into three regions, that is, a front region W1*a*, a middle region W1*b*, and a rear region W1*c*. The width of each region is substantially same as ⅓ width of the front half W1, that is, ⅙ width of the fin member 10. Similarly to the front half W1, the rear half W2 is divided into 3 regions, that is, a front region W2*a*, a middle region W2*b*, and a rear region W2*c*.

As can be seen in FIGS. 1A and 1B, in the first embodiment of the present invention, the raised portions 16 are disposed on the rear region W1*c* of the front half W1 and the front region W2*a* and rear region W2*c* of the rear half W2. The raised portions 16 are aligned in the longitudinal direction of the fin member 10 into rows. Preferably, two rows of the raised portions 16 are disposed on each of the rear region W1 c of the front half W1 and the front region W2*a* and rear region W2*c* of the rear half W2. However, it is apparent for those skilled in the art that the number of rows of the raised portions 16 can be varied according to the distance between the rows B1 and B2 of the heat exchanger tube and the width of the raised portions 16.

On the front region W1*a* and middle region W1*b* of the front half W1, there is no raised portion. That is, the front region W1*a* and middle region W1*b* of the front half W1 of the fin member 10 are flat. Similarly, on the middle region W2*b* of the rear half W2, there is no raised portion. That is, the middle region W2*b* of the rear half W2 of the fin member 10 is flat. The arrangement of the raised portions as above causes the resistance against the airflow to be reduced.

The configuration of the raised portions 16 will be discussed with reference to a traverse centerline C that passes through the center of a certain through-hole 12*a* of the front row B1. The raised portions 16*a*, 16*b*, 16*c*, 16*d*, 16*e* and 16*f* are symmetrically formed on the both sides of the traverse centerline C.

The raised portions 16*a*, 16*b*, 16*c* and 16*d* are positioned between the through-hole 12*a* disposed on the traverse centerline C and two through-holes 12*b* and 12*c* of the rear row B2 adjacent to the through-hole 12*a*. In the rearmost row in the rear region W2*c* of the rear half W2, there are two raised portions 16*f* and a raised portion 16*g* disposed between the raised portions 16*f*. The raised portions 16*f* and 16*g* have different shapes from those of the raised portions 16*a*, 16*b*, 16*c* and 16*d*.

Referring to FIG. 1A, as described above, the legs 18 of each raised portion 16 are inclined by a predetermined angle with respect to the traverse center line C passing through the center of the through-hole 12*a* of the front row B1. This configuration allows the air to direct to the tubes inserted in the through-holes 12*b* and 12*c* of the rear row B2. Finally, the configurations of the legs enhance the heat exchange performance at the tube and around the tubes of the rear row. The angle alpha preferably ranges from 5 to 45 degrees, and most preferably, is 15 degrees. It can be understood, however, that the angle may be varied in conformation with the interval and size of the tubes.

Referring to FIG. 1B, the raised portions 16 of a certain row and the raised portions 16 of the adjacent row protrude from the fin base 17 in the opposite direction to each other. As can be seen in FIGS. 1A to 1C, the cut and raised portions 16 is formed by way of cutting the fin base 17 and protruding the cut portion. A stamping die generally carries out the above process.

Figure 2:
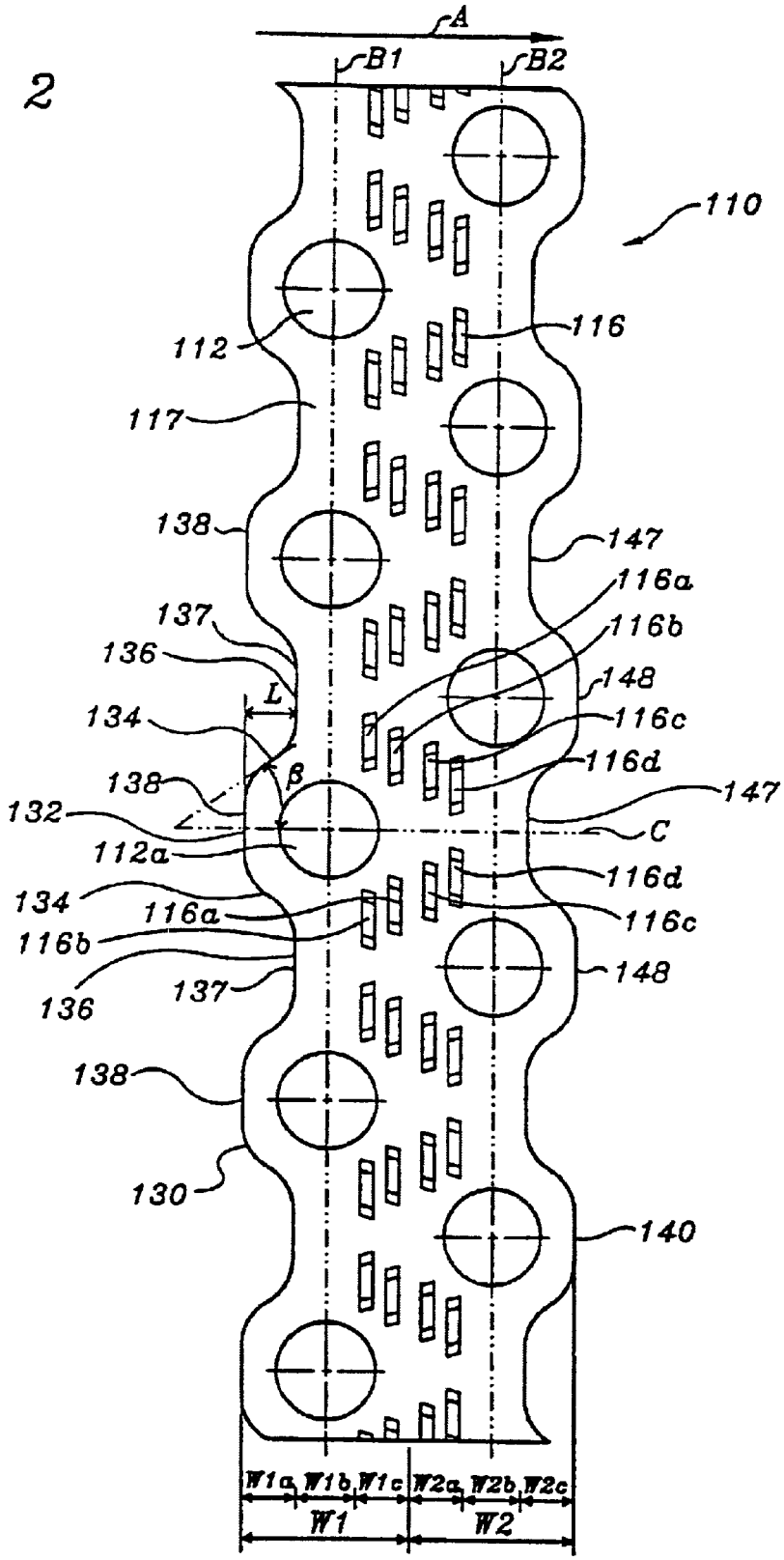
FIG. 2 is a side view showing a part of a fin member in accordance with the second embodiment of the present invention.

Now referring to FIG. 2, a fin tube heat exchanger in accordance with a second embodiment of the present invention has a plurality of fin members 110. The through-holes 112 are configured to be substantially same as those 12 of the fin member 10 in accordance with the first embodiment of the present invention. However, the configurations of a front edge line 130 and a rear edge line 140 of each fin member 11I are different from those of the front edge 30 and rear edge 40 of the fin member 10 described in the first embodiment of the present invention.

It will be described with reference to a traverse centerline C, which passes through the center of a certain through-hole 112*a* of the front row B1. As can be seen in FIG. 2, the edge line 130 has protruded portions 138 and recessed portions 137. The recessed portions 137 are offset from the protruded portions 138 at a distance L. The distance may be varied. It is preferable that the protruded portions 138 are formed at front of the through-holes 112 of the front row B1 and the recessed portions 147 are formed between die adjacent through-holes 112 of the rear row B2.

The protruded portions 138 and recessed portions 137 may be constructed of combinations of straight lines 132, 134 and 136 and curved lines. The protruded portions 138 and recessed portions 137 preferably are symmetrical with reference to the centerline C. However, in another embodiment, those 137 and 138 are unsymmetrical.

The protruded portion 138 and recessed portion 137 may be connected by a line 134. This line 134 is inclined at angle of 30 degrees with respect to the centerline C in a manner such that the distance from the traverse centerline C generally increases in a direction of the airflow A. Of course, when the protruded portion 138 and recessed portion 137 are connected by curved line without straight portion.

In a preferred embodiment, the protruded portions 138 of the front edge line 130 exactly correspond to the recessed portions 147 of the rear edge line 140. The protruded portions 148 of the rear edge line 140 exactly correspond to the recessed portions 137 of the front edge line 130. In other words, when the front edge line 130 is moved in a traverse direction of the fin member 110, the front edge 130 coincides with the rear edge 140.

Referring to FIGS. 2, raised portions 116 are disposed on a rear region W1 c of the front half W1 and a front region W2*a* of the rear half W2. The raised portions 116*a*, 116*b*, 116*c* and 116*d* are configured similarly to the raised portions 16*a*, 116*b*, 16*c* and 16*d* of the fin member 10 in accordance with the first embodiment.

Figure 3:
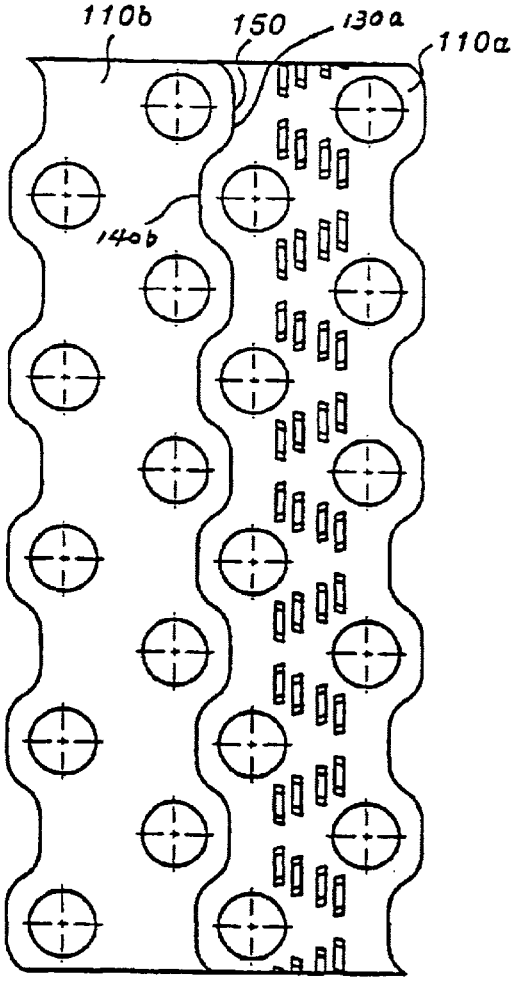
FIG. 3 is a schematic view showing the material saving effect when manufacturing the fin member in accordance with the second embodiment of the present invention.

Referring to FIG. 3. when manufacturing the fin members 110, first and second fin members 110*a* and 110*b* are divided by shearing process. The shearing line 150 becomes a front edge line 130*a* of the first fin member 110*a* and a rear edge line 140*b* of the second fin member 110*b*. As above, these configurations of the front and rear edge lines allow raw materials, for example aluminum plate, be saved. In addition to the saving of material, introduction of the configuration of the fin member 110 permits the weight of the heat exchanger to be reduced. Further, the pressure drop is diminished, and the carrying over of the condensed water is avoided.

In the second embodiment and FIG. 2, it is described and depicted so that the protruded portions 138, 148 and recessed portions 137, 147 are formed with the first, second and third straight lines 132, 134 and 136. Alternatively, in the modified embodiment, the protruded and recessed portions may be semicircular or oval.

Although the invention has been shown and described with respect to the exemplary embodiments, it should be understood that various changes, modifications and additions might be made without departing from the spirit and scope of the invention.

What is claimed is:

1. A fin tube heat exchanger comprising at least one plate-shaped elongated fin member for mounting on a plurality of heat exchange tubes, the fin member including:

a plurality of through-holes in at least two rows in a longitudinal direction of the fin member for receiving heat exchange tubes, the fin member being divided into a front half and a rear half by a centerline extending in the longitudinal direction, one of the rows of through-holes being disposed in the front half of the fin member and another of the rows of the through-holes being disposed in the rear half of the fin member, each of the front half and the rear half being divided in the longitudinal direction into front, middle, and rear regions, the fin member being disposed with respect to an air flow direction so that air flows across the front half of the fin member before flowing across the rear half of the fin member; and a plurality of raised portions with legs, disposed only in the rear region of the front half and the front region of the rear half of the fin member, each raised portion having at least one leg inclined at an angle with respect to a line transverse to the longitudinal direction of the fin member and passing through a center of an adjacent through-hole in the front half of the fin member so that distance from the line to each leg generally increases along the leg in the direction of airflow across the fin member.

2. The fin tube heat exchanger of claim 1, wherein the raised portions are aligned in a plurality of rows, substantially parallel to the rows of the through-holes.

3. The fin tube heat exchanger of claim 2, wherein the raised portions in a row protrude in an opposite direction from the protrusions of the raised portions of an adjacent row.

4. The fin tube heat exchanger of claim 1, wherein the angle ranges from 5 degrees to 45 degrees.

5. The fin tube heat exchanger of claim 4, wherein the angle is 15 degrees.

6. The fin tube heat exchanger of claim 1, wherein each fin member has a front edge and a rear edge, and at least one of the front edge and the rear edge has at least one protruding portion and one recessed portion.

7. The fin tube heat exchanger of claim 6, wherein the protruding portion is complementary to the recessed portion of the rear edge.

8. The fin tube heat exchanger of claim 6, wherein the protruding and recessed portions of the front and rear edges have curved shapes.

9. The fin tube heat exchanger of claim 8, wherein the protruding portion and recessed portion are connected by a line inclined at an angle with respect to the line which passes through the center of the adjacent through-hole so that distance from the line to one of the front and rear edges gradually increases in the direction of airflow across the fin member.

10. The fin tube heat exchanger of claim 9, wherein the angle is substantially 30 degrees.

11. The fin tube heat exchanger of claim 8, wherein the front edge has first straight lines extending in the longitudinal direction of the fin member, second lines extending in the direction of airflow across the fin member, and third lines extending in the longitudinal direction of the fin member and offset from the first straight lines.

12. The fin tube heat exchanger of claim 11, wherein the second lines are inclined at an angle with respect to the line which passes through the center of the adjacent through-hole so that distance to one of the front and rear edges from the line gradually increases in the direction of airflow across the fin member.

13. The fin tube heat exchanger of claim 1, wherein the front, middle, and rear regions of the front half of the fin member and the front, middle, and rear regions of the second half of the fin member have substantially equal widths transverse to the longitudinal direction of the fin member.

14. The fin tube heat exchanger of claim 1, wherein the front and middle regions of the front half of the fin member and the middle and rear regions of the rear half of the fin member are entirely flat.

* * * * *